US005763151A

United States Patent [19]

Brust et al.

[11] Patent Number: 5,763,151

[45] Date of Patent: Jun. 9, 1998

[54] ROBUST PROCESS FOR PREPARING HIGH BR LOW COV TABULAR GRAIN EMULSIONS

[75] Inventors: Thomas B. Brust, Webster; Philip J. Dale, Rochester; Philip J. Zola; Terrence R. O'Toole, both of Webster, all of N.Y.

[73] Assignee: Eastman Kodak Company, Rochester, N.Y.

[21] Appl. No.: 790,347

[22] Filed: Jan. 24, 1997

[51] Int. Cl.[6] ..... G03C 1/043; G03C 1/015; G03C 1/035

[52] U.S. Cl. ..... 430/569; 430/567; 430/637

[58] Field of Search ..... 430/567, 569, 430/637

[56] References Cited

U.S. PATENT DOCUMENTS

| | | | |
|---|---|---|---|
| 5,147,771 | 9/1992 | Tsaur et al. | 430/569 |
| 5,147,772 | 9/1992 | Tsaur et al. | 430/569 |
| 5,147,773 | 9/1992 | Tsaur et al. | 430/569 |
| 5,171,659 | 12/1992 | Tsaur et al. | 430/569 |
| 5,236,817 | 8/1993 | Kim et al. | 430/569 |
| 5,252,453 | 10/1993 | Tsaur et al. | 430/569 |
| 5,272,048 | 12/1993 | Kim et al. | 430/569 |
| 5,476,760 | 12/1995 | Fenton et al. | 430/569 |

*Primary Examiner*—Mark F. Huff
*Attorney, Agent, or Firm*—Carl O. Thomas

[57] ABSTRACT

A process is disclosed of preparing a photographic emulsion comprised of high bromide silver halide tabular grains accounting for greater than 90 percent of total grain projected area. The grains exhibit a low level of size dispersity by reason of forming in the presence of a dispersing medium containing a polyalkylene oxide block copolymer surfactant a population of silver halide grain nuclei containing twin planes, the halide content of the grain nuclei consisting essentially of silver bromide, and growing the silver halide grain nuclei containing twin planes to form the tabular silver halide grains. Inadvertent variation in tabular grain sizes and thicknesses from one precipitation to the next are minimized by growing the silver halide grain nuclei at a pH in the range of from 3.0 to 8.0 and in the presence of at least a 0.01M concentration of a partially dissociated acid having a pKa that is within 2.5 units of the pH and that forms a silver salt more soluble than the silver halide incorporated in the grains.

11 Claims, No Drawings

ROBUST PROCESS FOR PREPARING HIGH BR LOW COV TABULAR GRAIN EMULSIONS

FIELD OF THE INVENTION

The invention relates to a process of preparing photographic emulsions. More specifically, the invention relates to an improved process for the preparation of high bromide, low grain size dispersity tabular grain emulsions.

DEFINITION OF TERMS

In referring to grains and emulsions containing two or more halides, the halide are named in order of ascending concentrations.

The term "high bromide" in referring to grains and emulsions indicates that bromide is present in a concentration of greater than 50 mole percent, based on silver.

The term "equivalent circular diameter" or "ECD" is employed to indicate the diameter of a circle having the same projected area as a silver halide grain.

The term "coefficient of variation" or "COV" is defined as 100 times the standard deviation of grain ECD divided by average grain ECD.

The term "monodisperse" in referring to the grain population of a silver halide emulsion indicates a COV of less than 25 percent.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The term "pH" is the negative logarithm of the hydrogen ion concentration of a solution.

The term "pKa" is the negative logarithm of the thermodynamic acid dissociation constant (Ka) of an acid in solution.

The term "Ka" is defined by the relationship:

$$Ka=[H^+][A^-]\div HA$$

where HA represents undissociated acid and $H^+$ and $A^-$ represent dissociated hydrogen ion and anionic moieties, respectively, that together constitute the acid HA.

The term "Ksp" is the solubility product constant of a compound in solution.

The term "partially dissociated acid" is used to indicate an acid that in solution establishes an equilibrium between the acid molecule and its component hydrogen ion(s) and anionic moiety. Stated another way, it has a measurable Ka.

The term "robust" is employed to indicate emulsions that show reduced disparity in grain and performance characteristics from one preparation to the next attributable to inadvertent variances in preparation conditions.

*Research Disclosure* is published by Kenneth Mason Publications, Ltd., Dudley House, 12 North St., Emsworth, Hampshire P010 7DQ, England.

BACKGROUND

Photographic emulsions contain a dispersing medium and radiation-sensitive grains, which are typically silver halide microcrystals. Although markedly inferior in performance, other silver salts, such as silver thiocyanate, silver phosphate, silver cyanide, silver citrate and silver carbonate, can be precipitated in grain formation, as illustrated by Berriman U.S. Pat. No. 3,367,778, Maskasky U.S. Pat. Nos. 4,435,501, 4,463,087, 4,471,050 and 5,061,617 and Research Disclosure, Vol. 181, May 1979, Item 18153; Ikeda et al U.S. Pat. No. 4,921,784 and Brust et al U.S. Pat. No. 5,395,746.

The radiation-sensitive grains of photographic emulsions are usually formed by reacting a soluble silver salt, such as silver nitrate, with a soluble salt of the halide (or other anion), such as alkali, alkaline earth or ammonium halide. Precipitation can be undertaken under either acid or basic conditions. Under alkaline conditions the ammonium cation can act as a powerful ripening agent, usually resulting in large, highly ripened (sometimes described as spherical) grains. To minimize fog it is usually preferred to maintain a pH either near or on the acid side of neutrality during precipitation. Customarily strong mineral acids, such as nitric, sulfuric or hydrochloric acid are employed; however, other acids have been suggested from time to time for specific applications. For example, Maekawa et al U.S. Pat. No. 5,070,008 suggests the acid pH precipitation of silver halide grains containing at least 90 mole percent chloride, based on silver, using "inorganic acids such as sulfuric acid, hydrochloric acid and nitric acid, and organic acids such as acetic acid and citric acid." Sato et al U.S. Pat. No. 4,999,282 discloses adjusting pH after using an identified polymeric flocculating agent. Sato et al identifies as preferred examples "include organic acids such as acetic acid, citric acid and salicylic acid, and inorganic acids, such as nitric acid, sulfuric acid and phosphoric acid."

In the early 1980's it was recognized that a wide-ranging variety of performance advantages can be realized in high bromide silver halide emulsions when at least 50 percent of total grain projected area is accounted for by tabular grains. When interest initially focused on obtaining photographic performance advantages attributable to the tabular grains, the tabular grain emulsions contained a high proportion of nontabular grains, and the emulsions exhibited a high degree of grain size dispersity, attributable to the mixture of grain shapes as well as differences in the sizes of the tabular grains.

About a decade after the initial recognition of wide-ranging performance advantages for high bromide tabular grain emulsions, it was discovered that the presence of polyalkylene oxide block copolymer surfactants present during the formation of grain nuclei consisting essentially of silver bromide can significantly increase the proportion of the total grain population accounted for by tabular grains and produce highly monodisperse emulsions. Whereas previously tabular grain emulsions with COV's of less than 25 percent, based on only tabular grains, were only occasionally demonstrated, these modified precipitation techniques allowed COV's of less than 25 percent, based on the total grain population, to be realized consistently. In fact, extraordinary levels of monodispersity, with COV's, based on total grains, ranging below 10 percent were realized. Further, in these emulsion precipitations, tabular grains usually account for "substantially all" (defined as >97%) of total grain projected area. Preparations of monodisperse high bromide tabular grain emulsions employing polyalkylene oxide block copolymer surfactants are illustrated by the following:

| | |
|---|---|
| Tsaur et al | U.S. Pat. No. 5,147,771; |
| Tsaur et al | U.S. Pat. No. 5,147,772; |
| Tsaur et al | U.S. Pat. No. 5,147,773; |
| Tsaur et al | U.S. Pat. No. 5,171,659; |
| Tsaur et al | U.S. Pat. No. 5,252,453; |
| Kim et al | U.S. Pat. No. 5,272,048; and |
| Fenton et al | U.S. Pat. No. 5,476,760. |

PROBLEM TO BE SOLVED

Although the use of polyalkylene oxide block copolymer surfactants has dramatically lowered the grain dispersity of high bromide silver halide tabular grain emulsions, batch to batch variations in the mean thicknesses and ECD's of the tabular grains have been observed. In other words, the preparation processes have shown themselves to lack the degree of robustness desired using customary manufacturing control practices.

SUMMARY OF THE INVENTION

In one aspect this invention is directed to a process of preparing a photographic emulsion having silver halide grains including tabular grains containing greater than 50 mole percent bromide, based on silver, and accounting for greater than 90 percent of total grain projected area, the coefficient of variation of grain equivalent circular diameter, based on total grains, being less than 25 percent, said process being comprised of the steps of (1) forming in the presence of a dispersing medium containing a polyalkylene oxide block copolymer surfactant a population of silver halide grain nuclei containing twin planes, the halide content of the grain nuclei consisting essentially of silver bromide, and (2) growing the silver halide grain nuclei containing twin planes to form tabular silver halide grains, wherein the silver halide grain nuclei are grown at a pH in the range of from 3.0 to 8.0 and in the presence of at least a 0.01M concentration of a partially dissociated acid having a pKa that is within 2.5 units of the pH and that forms a silver salt more soluble than the silver halide incorporated in the grains.

Although polyalkylene oxide block copolymer surfactants consistently reduce the grain dispersity of high bromide tabular grain emulsions, the first discovery leading to the present invention was that these surfactants are susceptible to allowing batch to batch variations in tabular grain mean thicknesses and ECD's when emulsion precipitation conditions are inadvertently varied during emulsion manufacture. Thus, the first element of this invention can be attributed to the recognition of the problem of lack of manufacturing robustness of the polyalkylene oxide block copolymer precipitation process, never previously recognized or reported in the art.

A second element of this invention resides in the identification of a particular class of acids as being effective to impart robustness to the emulsion preparation process.

Further aspects of the invention can be appreciated by reference to the following detailed description, including the Examples containing emulsions prepared by the process of the invention and by comparative processes.

DESCRIPTION OF PREFERRED EMBODIMENTS

The process of the invention can be employed to prepare monodisperse high bromide tabular grain emulsions of the type described in the patents of Tsaur et al, Kim et al and Fenton et al, cited above and here incorporated by reference, by a modification of their precipitation processes. More specifically this invention is directed to a process of preparing photographic emulsions having silver halide grains including tabular grains containing greater than 50 mole percent bromide, based on silver, and accounting for greater than 90 percent of total grain projected area. The coefficient of variation (COV) of grain mean equivalent circular diameter (ECD), based on total grains is less than 25 percent.

The first step of the process is to form in the presence of a dispersing medium containing a polyalkylene oxide block copolymer surfactant a population of silver halide grain nuclei containing twin planes. The grain nuclei consist essentially of silver bromide.

The first step is followed by the step of growing the silver halide grain nuclei containing twin planes to form the desired tabular grain population. It has been discovered that, although the polyalkylene oxide block copolymer surfactant plays an essential role in producing a monodisperse grain population, the presence of the surfactant during grain growth renders the emulsions susceptible to batch to batch variations in grain mean ECD and mean thickness.

It has been further discovered that when the pH of grain growth is maintained within conventional ranges—e.g., in the customary range of from 3.0 to 8.0 and preferably within the range of from 5.0 to 7.0, the robustness of the emulsion preparation process can be increased (i.e., batch to batch variations in grain mean ECD and mean thickness can be reduced) by conducting grain growth in the presence of at least a 0.01 molar (preferably 0.01 to 0.05M) concentration of a partially dissociated acid having a pKa that is within 2.5 (preferably 1.5) units of the pH of the dispersing medium.

The pKa values of partially dissociated acids are well known and can be ascertained from published literature. Illustrations of common acids and their pKa's are set forth below. The pKa values are those reported by *The Handbook of Chemistry Physics,* 54th Ed., CRC Press, Cleveland, Ohio. Multifunctional acids, those capable of releasing more than one hydrogen ion, have a different pKa value for each hydrogen ion capable of being released. For these acids, if any one of the pKa values is within the above stated proximity to the pH of the dispersing medium under the conditions of grain growth, the acid is useful in the practice of the invention.

TABLE I

| Acid | °C. | pKa |
|---|---|---|
| Acetic | 25 | 4.75 |
| Acetoacetic | 18 | 3.58 |
| Adipamic | 25 | 4.63 |
| Adipic | 25 | 4.43 |
| | 25 | 4.41 |
| a-Aminoacetic (Glycine) | 25 | 9.78 |
| o-Aminobenzoic | 25 | 6.97 |
| m-Aminobenzoic | 25 | 4.78 |
| p-Aminobenzoic | 25 | 4.92 |
| m-Aminobenzosulfonic | 25 | 3.73 |
| p-Aminobenzosulfonic | 25 | 3.24 |
| Ascorbic | 25 | 4.10 |
| | 25 | 11.79 |
| DL-Aspartic | 25 | 3.86 |
| | 25 | 9.82 |
| Benzoic | 25 | 4.19 |
| o-Boric | 20 | 9.14 |
| | 20 | 12.74 |
| | 20 | 13.80 |
| n-Butyric | 20 | 4.81 |
| iso-Butyric | 18 | 4.84 |

TABLE I-continued

| Acid | °C. | pKa |
|---|---|---|
| Carbonic | 25 | 6.37 |
| | 25 | 10.25 |
| cis-Cinnamic | 25 | 3.89 |
| trans-Cinnamic | 25 | 4.44 |
| Citric | 18 | 3.14 |
| | 18 | 4.77 |
| | 18 | 6.39 |
| DL-Cysteine | 30 | 8.14 |
| | 30 | 10.34 |
| L-Cysteine | 25 | 7.85 |
| | 25 | 9.85 |
| Dimethylglycine | 25 | 9.89 |
| Dimethylmalic | 25 | 3.17 |
| | 25 | 6.06 |
| Dimethylmalonic | 25 | 3.15 |
| Diphenylacetic | 25 | 3.94 |
| Ethylbenzoic | 25 | 4.35 |
| Ethylphenylacetic | 25 | 4.37 |
| Formic | 20 | 3.75 |
| trans-Fumaric | 18 | 3.03 |
| | 18 | 4.44 |
| Gallic | 25 | 4.41 |
| Glutaramic | 25 | 4.60 |
| Glutaric | 25 | 4.34 |
| | 25 | 5.41 |
| Glycolic | 25 | 3.83 |
| Heptanoic | 25 | 4.89 |
| m-Hydroxybenzoic | 19 | 4.06 |
| | 19 | 9.92 |
| p-Hydroxybenzoic | 19 | 4.48 |
| | 19 | 9.32 |
| β-Hydroxybutyric | 25 | 4.70 |
| γ-Hydroxybutyric | 25 | 4.72 |
| β-Hydroxyproionic | 25 | 4.51 |
| Itaconic | 25 | 3.85 |
| | 25 | 5.45 |
| Lactic | 100 | 3.08 |
| Maleic | 25 | 1.83 |
| | 25 | 6.07 |
| Malic | 25 | 3.40 |
| | 25 | 5.11 |
| Malonic | 25 | 2.83 |
| | 25 | 5.69 |
| DL-Mandelic | 25 | 3.85 |
| Mesaconic | 25 | 3.09 |
| | 25 | 4.75 |
| Mesitylenic | 25 | 4.32 |
| Methyl-o-aminobenzoic | 25 | 5.34 |
| Methyl-m-aminobenzoic | 25 | 5.10 |
| Methyl-p-aminobenzoic | 25 | 5.04 |
| o-Methylcinnamic | 25 | 4.50 |
| m-Methylcinnamic | 25 | 4.44 |
| p-Methylcinnamic | 25 | 4.56 |
| β-Methylglutaric | 25 | 4.24 |
| Methylmalonic | 25 | 3.07 |
| Methylsuccinic | 25 | 4.13 |
| | 25 | 5.64 |
| α-Napthoic | 25 | 3.70 |
| β-Naphtoic | 25 | 4.17 |
| Nonanic | 25 | 4.96 |
| Octanoic | 25 | 4.89 |
| Oxalic | 25 | 1.23 |
| | 25 | 4.19 |
| Phenylacetic | 18 | 4.28 |
| o-Phenylbenzoic | 25 | 3.46 |
| γ-Phenylbutyric | 25 | 4.76 |
| α-Phenylpropionic | 25 | 4.64 |
| β-Phenylpropionic | 25 | 4.37 |
| o-Phosphoric | 25 | 2.12 |
| | 25 | 7.21 |
| | 25 | 12.67 |
| Phosphorous | 18 | 2.00 |
| | 18 | 6.59 |
| o-Phthalic | 25 | 2.89 |
| | 25 | 5.51 |
| m-Phthalic | 25 | 3.54 |
| | 18 | 4.60 |

TABLE I-continued

| Acid | °C. | pKa |
|---|---|---|
| p-Phthalic | 25 | 3.51 |
| | 16 | 4.82 |
| Pimelic | 25 | 4.71 |
| iso-Propylbenzoic | 25 | 4.40 |
| Pyrophosphoric | 18 | 0.85 |
| | 18 | 1.49 |
| | 18 | 5.77 |
| | 18 | 8.22 |
| Suberic | 25 | 4.52 |
| Succinic | 25 | 4.16 |
| | 25 | 5.61 |
| Sulfanilic | 25 | 3.23 |
| Sulfurous | 18 | 1.81 |
| | 18 | 6.91 |
| α-Tartaric | 25 | 2.98 |
| | 25 | 4.34 |
| meso-Tartaric | 25 | 3.22 |
| | 25 | 4.82 |
| Terephthalic | 25 | 3.51 |
| Tetraboric | 25 | ~4 |
| | 25 | ~7 |
| o-Toluic | 25 | 3.91 |
| m-Toluic | 25 | 4.27 |
| p-Toluic | 25 | 4.36 |
| Trimethylacetic acid | 18 | 5.03 |
| Tryptophan | 25 | 9.38 |
| Tyrosine | 17 | 8.40 |
| n-Valeric | 18 | 4.82 |
| iso-Valeric | 25 | 4.77 |

To insure that the acid anion does not become incorporated in the silver halide grains, acids are chosen that form silver salts more soluble than the silver halide being incorporated in the grains during growth. Stated another way, if the acid forms a silver salt that has a higher Ksp (or lower −log Ksp, a.k.a. pKsp) than the silver halide being precipitated, the silver salt of the acid remains in solution while the silver halide is preferentially precipitated.

When silver and halide ions react, the majority of the silver and halide ions are incorporated in the grains, but at equilibrium a small fraction of the silver and halide ions are also present in the dispersing medium, as illustrated by the following relationship:

$$Ag^+ + X^- \rightleftharpoons AgX \qquad \text{(II)}$$

where X represents halide. From relationship (II) it is apparent that most of the silver and halide ions at equilibrium are in an insoluble form while the concentration of soluble silver ions ($Ag^+$) and halide ions ($X^-$) is limited. At any given temperature the activity product of $Ag^+$ and $X^-$ is at equilibrium a constant and satisfies the relationship:

$$Ksp=[Ag^+][X^-] \qquad \text{(III)}$$

where Ksp is the solubility product constant of the silver halide. To avoid working with small fractions the following relationship is also widely employed:

$$-\log Ksp=pAg+pX \qquad \text{(IV)}$$

where pAg represents the negative logarithm of the equilibrium silver ion activity and pX represents the negative logarithm of the equilibrium halide ion activity. From relationship (IV) it is apparent that the larger the value of the −log Ksp for a given halide, the lower is its solubility. The relative solubilities of the photographic halides (Cl, Br and I) can be appreciated by reference to Table V:

TABLE V

| Temp. °C. | AgCl −log Ksp | AgBr −log Ksp | AgI −log Ksp |
|---|---|---|---|
| 40 | 9.2 | 11.6 | 15.2 |
| 50 | 8.9 | 11.2 | 14.6 |
| 60 | 8.6 | 10.8 | 14.1 |
| 80 | 8.1 | 10.1 | 13.2 |

In choosing a partially dissociable acid to be present during grain growth that does not significantly alter the composition of the silver halide grains being grown, the acid (i.e., HA, defined above) is chosen to form a silver salt AgA having an equilibrium shifted toward ionic dissociation as compared to AgX. In other words, the following relationships are satisfied:

$$Ksp_{AgX} < Ksp_{AgA} \quad \text{(VI)}$$

and $$-\log Ksp_{AgX} > -\log Ksp_{AgA} \quad \text{(VII)}$$

James *The Theory of the Photographic Process*, 4th Ed., Macmillan, New York, 1977, in Table 1.4, p. 8, and Table 1.5, p. 9, reports −log Ksp (pKsp) values for the silver halides found in photographic emulsion grains and the silver salts of several of the partially dissociated acids listed in Table I.

When two or more halides are being concurrently precipitated during grain growth, it is appreciated that it is the −log Ksp of the most soluble silver halide that controls acid selection. For example, if silver chloride, even in minor amounts, is intended to be incorporated along with silver bromide during grain growth, the acid is selected to have a −log Ksp of <9.75 at room temperature, the −log Ksp of silver chloride. On the other hand, if the chloride is omitted from the grains and only silver bromide is being precipitated, the acid can have a −log Ksp of <12.31, the −log Ksp of silver bromide. If a small amount of iodide is incorporated in the grains in addition to bromide, no further increase in the −log Ksp of the acid is permissible, even though the −log Ksp of silver iodide at room temperature is 16.09, since the more soluble silver bromide controls the maximum −log Ksp of the acid.

Although the acids are effective in the preferred molar concentration range of from 0.01 to 0.05M set out above, it is appreciated that, as the acids form more soluble silver salts, higher acid concentrations can be tolerated without risk of incorporation of the acid anion in the grain structure. Thus, for acids having a −log Ksp below 9.0, acid concentrations can range up to 0.5M or even higher.

It is preferred to rely primarily upon fully dissociated acids (e.g., $HNO_3$ or HCl) and bases (e.g., NaOH or KOH) for establishing precipitation pH ranges. Neither $HNO_3$ nor HCl have any measurable Ka, since they fully dissociate into cationic and anionic moieties in solution. It can be readily recognized that these acids are ideally suitable for pH adjustment, since the nitrate anion $NO_3^-$ is incapable of reacting with silver to form a precipitate and the chloride anion $Cl^-$ is itself a halide and, further, incapable of displacing either bromide or iodide ion from the grain structure.

As fully described by Tsaur et al, Kim et al and Fenton et al, cited and incorporated by reference above, the first step in the emulsion preparation process is to form within a dispersing medium a population of silver halide grain nuclei containing the twin planes necessary to produce tabular grains. To achieve the lowest possible grain dispersities the first step is to undertake formation of the silver halide grain nuclei under conditions that promote uniformity. Prior to forming the grain nuclei bromide ion is added to the dispersing medium. Although other halides can be added to the dispersing medium along with silver, prior to introducing silver, halide ions in the dispersing medium consist essentially of bromide ions.

The balanced double jet precipitation of grain nuclei is specifically contemplated in which an aqueous silver salt solution and an aqueous bromide salt are concurrently introduced into a dispersing medium containing water and a hydrophilic colloid peptizer. One or both of chloride and iodide salts can be introduced through the bromide jet or as a separate aqueous solution through a separate jet. While chloride and/or iodide can be incorporated during formation of the grain nuclei in any concentration taught by Tsaur et al, Kim et al or Fenton et al, it is preferred to minimize or eliminate chloride and/or iodide concentrations during grain nucleation. Silver nitrate is the most commonly utilized silver salt while the halide salts most commonly employed are ammonium halides and alkali metal (e.g., lithium, sodium or potassium) halides. When an ammonium counter ion is employed an acid pH—i.e., less than 7.0, is employed to avoid ammonia ripening of the grain nuclei as they are being formed.

Instead of introducing aqueous silver and halide salts through separate jets a uniform nucleation can be achieved by introducing a Lippmann emulsion into the dispersing medium. Since the Lippmann emulsion grains typically have a mean ECD of less than 0.05 μm, a small fraction of the Lippmann grains initially introduced serve as deposition sites while all of the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al U.S. Pat. No. 4,433,048.

To reduce the dispersity of the grain nuclei as they are formed and thereby dramatically lower the COV of the final grain population produced by precipitation, a polyalkylene oxide block copolymer surfactant is employed during formation of the grain nuclei. Polyalkylene oxide block copolymer surfactants generally and those contemplated for use in preparing the emulsions of this invention in particular are well known and have been widely used for a variety of purposes. They are generally recognized to constitute a major category of nonionic surfactants. For a molecule to function as a surfactant it must contain at least one hydrophilic unit and at least one lipophilic unit linked together. A general review of block copolymer surfactants is provided by I. R. Schmolka, "A Review of Block Polymer Surfactants", J. Am. Oil Chem. Soc., Vol. 54, No. 3, 1977, pp. 110–116, and A. S. Davidsohn and B. Milwidsky, *Synthetic Detergents*, John Wiley & Sons, N.Y. 1987, pp. 29–40, and particularly pp. 34–36.

One category of polyalkylene oxide block copolymer surfactant found to be useful in the preparation of the emulsions is comprised of two terminal lipophilic alkylene oxide block units linked by a hydrophilic alkylene oxide block unit accounting for at least 4 percent of the molecular weight of the copolymer. These surfactants are hereinafter referred to category S-I surfactants.

The category S-I surfactants contain at least two terminal lipophilic alkylene oxide block units linked by a hydrophilic alkylene oxide block unit and can be, in a simple form, schematically represented as indicated by diagram VIII below:

| LAO1 | HAO1 | LAO1 | (VIII)

where

LAO1 in each occurrence represents a terminal lipophilic alkylene oxide block unit and HAO1 represents a linking hydrophilic alkylene oxide block unit.

It is generally preferred that HAO1 be chosen so that the hydrophilic block unit constitutes from 4 to 96 percent of the block copolymer on a total weight basis.

It is, of course, recognized that the block diagram VIII above is only one example of a polyalkylene oxide block copolymer having at least two terminal lipophilic block units linked by a hydrophilic block unit. In a common variant structure interposing a trivalent amine linking group in the polyalkylene oxide chain at one or both of the interfaces of the LAO1 and HAO1 block units can result in three or four terminal lipophilic groups.

In their simplest possible form the category S-I polyalkylene oxide block copolymer surfactants are formed by first condensing ethylene glycol and ethylene oxide to form an oligomeric or polymeric block repeating unit that serves as the hydrophilic block unit and then completing the reaction using 1,2-propylene oxide. The propylene oxide adds to each end of the ethylene oxide block unit. At least six 1,2-propylene oxide repeating units are required to produce a lipophilic block repeating unit. The resulting polyalkylene oxide block copolymer surfactant can be represented by formula IX:

$$HO-(\overset{CH_3}{\overset{|}{C}}HCH_2O)_{x'}-(CH_2CH_2O)_y-(\overset{CH_3}{\overset{|}{C}}H_2CHO)_{x'}-H \quad (IX)$$

where x and x' are each at least 6 and can range up to 120 or more and y is chosen so that the ethylene oxide block unit maintains the necessary balance of lipophilic and hydrophilic qualities necessary to retain surfactant activity. It is generally preferred that y be chosen so that the hydrophilic block unit constitutes from 4 to 96 percent by weight of the total block copolymer. Within the above ranges for x and x', y can range from 2 to 300 or more.

Generally any category S-I surfactant block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 16,000, preferably less than about 10,000, are contemplated for use.

In a second category, hereinafter referred to as category S-II surfactants, the polyalkylene oxide block copolymer surfactants contain two terminal hydrophilic alkylene oxide block units linked by a lipophilic alkylene oxide block unit and can be, in a simple form, schematically represented as indicated by diagram X below:

| HAO2 | LAO2 | HAO2 | (X)

where

HAO2 in each occurrence represents a terminal hydrophilic alkylene oxide block unit and LAO2 represents a linking lipophilic alkylene oxide block unit. It is generally preferred that LAO2 be chosen so that the lipophilic block unit constitutes from 4 to 96 percent of the block copolymer on a total weight basis.

It is, of course, recognized that the block diagram X above is only one example of a category S-II polyalkylene oxide block copolymer having at least two terminal hydrophilic block units linked by a lipophilic block unit. In a common variant structure interposing a trivalent amine linking group in the polyakylene oxide chain at one or both of the interfaces of the LAO2 and HAO2 block units can result in three or four terminal hydrophilic groups.

In their simplest possible form the category S-II polyalkylene oxide block copolymer surfactants are formed by first condensing 1,2-propylene glycol and 1,2-propylene oxide to form an oligomeric or polymeric block repeating unit that serves as the lipophilic block unit and then completing the reaction using ethylene oxide. Ethylene oxide is added to each end of the 1,2-propylene oxide block unit. At least thirteen (13) 1,2-propylene oxide repeating units are required to produce a lipophilic block repeating unit. The resulting polyalkylene oxide block copolymer surfactant can be represented by formula XI:

$$HO-(CH_2CH_2O)_{y'}-(\overset{CH_3}{\overset{|}{C}}HCH_2O)_x-(CH_2CH_2O)_y-H \quad (XI)$$

where x is at least 13 and can range up to 490 or more and y and y' are chosen so that the ethylene oxide block units maintain the necessary balance of lipophilic and hydrophilic qualities necessary to retain surfactant activity. It is generally preferred that x be chosen so that the lipophilic block unit constitutes from 4 to 96 percent by weight of the total block copolymer; thus, within the above range for x, y and y' can range from 1 to 320 or more.

Any category S-II block copolymer surfactant that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general surfactants having molecular weights of less than about 30,000, preferably less than about 20,000, are contemplated for use.

In a third category, hereinafter referred to as category S-III surfactants, the polyalkylene oxide surfactants contain at least three terminal hydrophilic alkylene oxide block units linked through a lipophilic alkylene oxide block linking unit and can be, in a simple form, schematically represented as indicated by formula XII below:

$$(H-HAO_3)-LOL-(HAO_3-H)_z, \quad (XII)$$

where

HAO3 in each occurrence represents a terminal hydrophilic alkylene oxide block unit, LOL represents a lipophilic alkylene oxide block linking unit, z is 2 and z' is 1 or 2.

The polyalkylene oxide block copolymer surfactants employed can take the form shown in formula XIII:

$$(H—HAO_3—LAO_3)_z—L—(LAO_3—HAO_3—H)_{z'} \quad (XIII)$$

where

HAO3 in each occurrence represents a terminal hydrophilic alkylene oxide block unit, LAO3 in each occurrence represents a lipophilic alkylene oxide block unit, L represents a linking group, such as amine or diamine, z is 2 and z' is 1 or 2.

The linking group L can take any convenient form. It is generally preferred to choose a linking group that is itself lipophilic. When z+z' equal three, the linking group must be trivalent. Amines can be used as trivalent linking groups. When an amine is used to form the linking unit L, the polyalkylene oxide block copolymer surfactants employed can take the form shown in formula XIV:

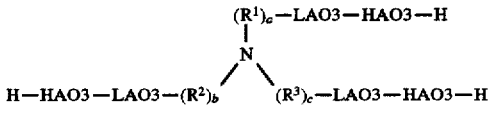

where

HAO3 and LAO3 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XIV.

When z+z' equal four, the linking group must be tetravalent. Diamines are preferred tetravalent linking groups. When a diamine is used to form the linking unit L, the polyalkylene oxide block copolymer surfactants employed can take the form shown in formula XV:

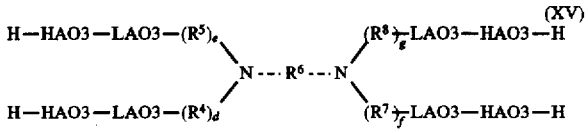

where

HAO3 and LAO3 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1. It is generally preferred that LAO3 be chosen so that the LOL lipophilic block unit accounts for from 4 to less than 96 percent, preferably from 15 to 95 percent, optimally 20 to 90 percent, of the molecular weight of the copolymer.

In a fourth category, hereinafter referred to as category S-IV surfactants, the polyalkylene oxide block copolymer surfactants employed contain at least three terminal lipophilic alkylene oxide block units linked through a hydrophilic alkylene oxide block linking unit and can be, in a simple form, schematically represented as indicated by formula XVI below:

$$(H-LAO4)_z—HOL—(LAC4—H)_{z'} \quad (XVI)$$

where

LAO4 in each occurrence represents a terminal lipophilic alkylene oxide block unit, HOL represents a hydrophilic alkylene oxide block linking unit, z is 2 and z' is 1 or 2.

The polyalkylene oxide block copolymer surfactants employed can take the form shown in formula XVII:

$$(H—LAO4—HAO4)_z—L'—(HAO4—LAO4—H)_{z'} \quad (XVII)$$

where

HAO4 in each occurrence represents a hydrophilic alkylene oxide block unit,

LAO4 in each occurrence represents a terminal lipophilic alkylene oxide block unit, L' represents a linking group, such as amine or diamine, z is 2 and z' is 1 or 2.

The linking group L' can take any convenient form. It is generally preferred to choose a linking group that is itself hydrophilic. When z+z' equal three, the linking group must be trivalent. Amines can be used as trivalent linking groups. When an amine is used to form the linking unit L', the polyalkylene oxide block copolymer surfactants employed can take the form shown in formula XVIII:

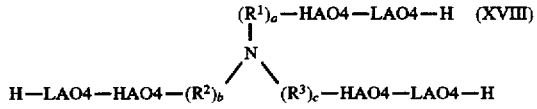

where

HAO4 and LAO4 are as previously defined;

$R^1$, $R^2$ and $R^3$ are independently selected hydrocarbon linking groups, preferably phenylene groups or alkylene groups containing from 1 to 10 carbon atoms; and a, b and c are independently zero or 1. To avoid steric hindrances it is generally preferred that at least one (optimally at least two) of a, b and c be 1. An amine (preferably a secondary or tertiary amine) having hydroxy functional groups for entering into an oxyalkylation reaction is a contemplated starting material for forming a polyalkylene oxide block copolymer satisfying formula XVIII.

When z+z' equal four, the linking group must be tetravalent. Diamines are preferred tetravalent linking groups. When a diamine is used to form the linking unit L', the polyalkylene oxide block copolymer surfactants employed can take the form shown in formula XIX:

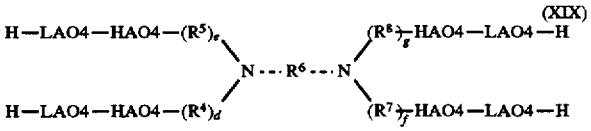

where

HAO4 and LAO4 are as previously defined;

$R^4$, $R^5$, $R^6$, $R^7$ and $R^8$ are independently selected hydrocarbon linking groups, preferably phenylene groups or alkylene groups containing from 1 to 10 carbon atoms; and d, e, f and g are independently zero or 1. It is generally preferred that LAO4 be chosen so that the HOL hydrophilic block unit accounts for from 4 to 96 percent, preferably from 5 to 85 percent, of the molecular weight of the copolymer.

In their simplest possible form the polyalkylene oxide block copolymer surfactants of categories S-III and S-IV employ ethylene oxide repeating units to form the hydrophilic (HAO3 and HAO4) block units and 1,2-propylene oxide repeating units to form the lipophilic (LAO3 and LAO4) block units. At least three propylene oxide repeating units are required to produce a lipophilic block repeating unit. When so formed, each H—HAO3—LAO3— or H—LAO4—HAO4— group satisfies formula XXa or XXb, respectively:

$$H-(OCH_2CH_2)_y-(OCH(CH_3)CH_2)_x- \quad \text{(XXa)}$$

$$H-(OCH(CH_3)CH_2)_x-(OCH_2CH_2)_y- \quad \text{(XXb)}$$

where x is at least 3 and can range up to 250 or more and y is chosen so that the ethylene oxide block unit maintains the necessary balance of lipophilic and hydrophilic qualities necessary to retain surfactant activity. This allows y to be chosen so that the hydrophilic block units together constitute from greater than 4 to 96 percent (optimally 10 to 80 percent) by weight of the total block copolymer. In this instance the lipophilic alkylene oxide block linking unit, which includes the 1,2-propylene oxide repeating units and the linking moieties, constitutes from 4 to 96 percent (optimally 20 to 90 percent) of the total weight of the block copolymer. Within the above ranges, y can range from 1 (preferably 2) to 340 or more.

The overall molecular weight of the polyalkylene oxide block copolymer surfactants of categories S-III and S-IV have a molecular weight of greater than 1100, preferably at least 2,000. Generally any such block copolymer that retains the dispersion characteristics of a surfactant can be employed. It has been observed that the surfactants are fully effective either dissolved or physically dispersed in the reaction vessel. The dispersal of the polyalkylene oxide block copolymers is promoted by the vigorous stirring typically employed during the preparation of tabular grain emulsions. In general category S-III surfactants having molecular weights of less than about 60,000, preferably less than about 40,000, are contemplated for use, category S-IV surfactants having molecular weight of less than 50,000, preferably less than about 30,000, are contemplated for use.

While commercial surfactant manufacturers have in the overwhelming majority of products selected 1,2-propylene oxide and ethylene oxide repeating units for forming lipophilic and hydrophilic block units of nonionic block copolymer surfactants on a cost basis, it is recognized that other alkylene oxide repeating units can, if desired, be substituted in any of the category S-I, S-II, S-III and S-IV surfactants, provided the intended lipophilic and hydrophilic properties are retained. For example, the propylene oxide repeating unit is only one of a family of repeating units that can be illustrated by formula XXI $$-(OCH(R^9)CH_2)- \quad \text{(XXI)}$$

where $R^9$ is a lipophilic group, such as a hydrocarbon—e.g., alkyl of from 1 to 10 carbon atoms or aryl of from 6 to 10 carbon atoms, such as phenyl or naphthyl.

In the same manner, the ethylene oxide repeating unit is only one of a family of repeating units that can be illustrated by formula XXII:

$$-(OCH(R^{10})CH_2)- \quad \text{(XXII)}$$

where $R^{10}$ is hydrogen or a hydrophilic group, such as a hydrocarbon group of the type forming $R^9$ above additionally having one or more polar substituents—e.g., one, two, three or more hydroxy and/or carboxy groups.

In each of the surfactant categories each of block units contain a single alkylene oxide repeating unit selected to impart the desired hydrophilic or lipophilic quality to the block unit in which it is contained. Hydrophilic-lipophilic balances (HLB's) of commercially available surfactants are generally available and can be consulted in selecting suitable surfactants.

Only very low levels of surfactant are required in the emulsion at the time parallel twin planes are being introduced in the grain nuclei to reduce the grain dispersity of the emulsion being formed. Surfactant weight concentrations are contemplated as low as 0.1 percent, based on the interim weight of silver—that is, the weight of silver present in the emulsion while twin planes are being introduced in the grain nuclei. A preferred minimum surfactant concentration is 1 percent, based on the interim weight of silver. A broad range of surfactant concentrations have been observed to be effective. No further advantage has been realized for increasing surfactant weight concentrations above 100 percent of the interim weight of silver using category S-I surfactants or above 50 percent of the interim weight of silver using category S-II, S-III or S-IV surfactants. However, surfactant concentrations of 200 percent of the interim weight of silver or more are considered feasible using category S-I surfactants or 100 percent or more using category S-II, S-III or S-IV surfactants.

The preparation process is compatible with either of the two most common techniques for introducing parallel twin planes into grain nuclei. The preferred and most common of these techniques is to form the grain nuclei population that will be ultimately grown into tabular grains while concurrently introducing parallel twin planes in the same precipitation step. In other words, grain nucleation occurs under conditions that are conducive to twinning. The second approach is to form a stable grain nuclei population and then adjust the pAg of the interim emulsion to a level conducive to twinning.

Regardless of which approach is employed, it is advantageous to introduce the twin planes in the grain nuclei at an early stage of precipitation. It is contemplated to obtain a grain nuclei population containing parallel twin planes using less than 2 percent of the total silver used to form the tabular grain emulsion. It is usually convenient to use at least 0.05 percent of the total silver to form the parallel twin plane containing grain nuclei population, although this can be accomplished using even less of the total silver. The longer introduction of parallel twin planes is delayed after forming a stable grain nuclei population the greater is the tendency toward increased grain dispersity.

At the stage of introducing parallel twin planes in the grain nuclei, either during initial formation of the grain nuclei or immediately thereafter, the lowest attainable levels of grain dispersity in the completed emulsion are achieved by control of the dispersing medium. The pAg of the dispersing medium is preferably maintained in the range of from 5.4 to 10.3 and, for achieving a COV of less than 10 percent, optimally in the range of from 7.0 to 10.0. At a pAg of greater than 10.3 a tendency toward increased tabular grain ECD and thickness dispersities is observed. Any convenient conventional technique for monitoring and regulating pAg can be employed. During grain nucleation the pH of the dispersing medium is preferably maintained at less than 6.0 at the time parallel twin planes are being introduced to lower grain dispersity. Otherwise the pH of the dispersing medium during grain nuclei formation can be can be regulated similarly as described above for grain growth regulation. The presence of a partially dissociated acid during grain nucleation is fully compatible with the practice of the invention, but not required.

Grain nucleation and growth occurs in a dispersing medium comprised of water, dissolved salts and a conventional peptizer. Hydrophilic colloid peptizers such as gelatin and gelatin derivatives are specifically contemplated. Peptizer concentrations of from 20 to 800 (optimally 40 to 600) grams per mole of silver introduced during the nucleation step have been observed to produce emulsions of the lowest grain dispersity levels.

The formation of grain nuclei containing parallel twin planes is undertaken at conventional precipitation temperatures for photographic emulsions, with temperatures in the range of from 20° to 80° C. being particularly preferred and temperature of from 20° to 60° C. being optimum.

Once a population of grain nuclei containing parallel twin planes has been established as described above, the next step is to reduce the dispersity of the grain nuclei population by ripening. The objective of ripening grain nuclei containing parallel twin planes to reduce dispersity is disclosed by both Himmelwright U.S. Pat. No. 4,477,565 and Nottorf U.S. Pat. No. 4,722,886, the disclosures of which are here incorporated by reference. Ammonia and thioethers in concentrations of from about 0.01 to 0.1N constitute preferred ripening agent selections.

Instead of introducing a silver halide solvent to induce ripening it is possible to accomplish the ripening step by adjusting pH to a high level—e.g., greater than 9.0. A ripening process of this type is disclosed by Buntaine and Brady U.S. Pat. No. 5,013,641. In this process the post nucleation ripening step is performed by adjusting the pH of the dispersing medium to greater than 9.0 by the use of a base, such as an alkali hydroxide (e.g., lithium, sodium or potassium hydroxide) followed by digestion for a short period (typically 3 to 7 minutes). At the end of the ripening step the emulsion is again returned to the acidic pH ranges conventionally chosen for silver halide precipitation (e.g. less than 6.0) by introducing a conventional acidifying agent, such as a mineral acid (e.g., nitric acid).

Some reduction in dispersity will occur no matter how abbreviated the period of ripening. It is preferred to continue ripening until at least about 20 percent of the total silver has been solubilized and redeposited on the remaining grain nuclei. The longer ripening is extended the fewer will be the number of surviving nuclei. This means that progressively less additional silver halide precipitation is required to produce tabular grains of an aim ECD in a subsequent growth step. Looked at another way, extending ripening decreases the size of the emulsion make in terms of total grams of silver precipitated. Optimum ripening will vary as a function of aim emulsion requirements and can be adjusted as desired.

Once nucleation and ripening have been completed, further growth of the emulsions can be undertaken in any conventional manner consistent with achieving desired final mean grain thicknesses and ECDs. The halides introduced during grain growth can be selected independently of the halide selections for nucleation. The tabular grain emulsion can contain grains of either uniform or nonuniform silver halide composition.

In optimizing the process of preparation for minimum tabular grain dispersity levels it has been observed that optimizations differ as a function of iodide incorporation in the grains as well as the choices of surfactants and/or peptizers.

While any conventional hydrophilic colloid peptizer can be employed, it is preferred to employ gelatino-peptizers during precipitation. Gelatino-peptizers are commonly divided into so-called "regular" gelatino-peptizers and so-called "oxidized" gelatino-peptizers. Regular gelatino-peptizers are those that contain naturally occurring amounts of methionine of at least 30 micromoles of methionine per gram and usually considerably higher concentrations. The term oxidized gelatino-peptizer refers to gelatino-peptizers that contain less than 30 micromoles of methionine per gram. A regular gelatino-peptizer is converted to an oxidized gelatino-peptizer when treated with a strong oxidizing agent, such as taught by Maskasky U.S. Pat. No. 4,713,323 and King et al U.S. Pat. No. 4,942,120, the disclosures of which are here incorporated by reference. The oxidizing agent attacks the divalent sulfur atom of the methionine moiety, converting it to a tetravalent or, preferably, hexavalent form. While methionine concentrations of less than 30 micromoles per gram have been found to provide oxidized gelatino-peptizer performance characteristics, it is preferred to reduce methionine concentrations to less than 12 micromoles per gram. Any efficient oxidation will generally reduce methionine to less than detectable levels. Since gelatin in rare instances naturally contains low levels of methionine, it is recognized that the terms "regular" and "oxidized" are used for convenience of expression while the true distinguishing feature is methionine level rather than whether or not an oxidation step has been performed.

When an oxidized gelatino-peptizer is employed, it is preferred to maintain a pH during twin plane formation of less than 5.2 to achieve a minimum (less than 10 percent) COV. When a regular gelatino-peptizer is employed, the pH during twin plane formation is maintained at less than 3.0 to achieve a minimum COV.

When regular gelatin and a category S-I surfactant are each employed prior to post-ripening grain growth, the category S-I surfactant is selected so that the hydrophilic block (e.g., HAO1) accounts for 4 to 96 (preferably 5 to 85 and optimally 10 to 80) percent of the total surfactant molecular weight. It is preferred that x and x' (in formula II) be at least 6 and that the minimum molecular weight of the surfactant be at least 760 and optimally at least 1000, with maximum molecular weights ranging up to 16,000, but preferably being less than 10,000.

When the category S-I surfactant is replaced by a category S-II surfactant, the latter is selected so that the lipophilic block (e.g., LAO2) accounts for 4 to 96 (preferably 15 to 95 and optimally 20 to 90) percent of the total surfactant molecular weight. It is preferred that x (formula XI) be at least 13 and that the minimum molecular weight of the surfactant be at least 800 and optimally at least 1000, with maximum molecular weights ranging up to 30,000, but preferably being less than 20,000.

When a category S-III surfactant is selected for this step, it is selected so that the lipophilic alkylene oxide block linking unit (LOL) accounts for 4 to 96 percent, preferably 15 to 95 percent, and optimally 20 to 90 percent of the total surfactant molecular weight. In the ethylene oxide and 1,2-propylene oxide forms shown in formula (XXa), x can range from 3 to 250 and y can range from 2 to 340 and the minimum molecular weight of the surfactant is greater than 1,100 and optimally at least 2,000, with maximum molecular weights ranging up to 60,000, but preferably being less than 40,000. The concentration levels of surfactant are preferably restricted as iodide levels are increased.

When a category S-IV surfactant is selected for this step, it is selected so that the hydrophilic alkalylene oxide block linking unit (HOL) accounts for 4 to 96 percent, preferably 5 to 85 percent, and optimally 10 to 80 percent of the total surfactant molecular weight. In the ethylene oxide and 1,2-propylene oxide forms shown in formula (XXb), x can range from 3 to 250 and y can range from 2 to 340 and the minimum molecular weight of surfactant is greater than 1,100 and optimally at least 2,000, with maximum molecular weights ranging up to 50,000, but preferably being less than 30,000.

When oxidized gelatino-peptizer is employed prior to post-ripening grain growth and no iodide is added during post-ripening grain growth, minimum COV emulsions can be prepared with category S-I surfactants chosen so that the hydrophilic block (e.g., HAO1) accounts for 4 to 35 (optimally 10 to 30) percent of the total surfactant molecular weight. The minimum molecular weight of the surfactant continues to be determined by the minimum values of x and x' (formula XIV) of 6. In optimized forms x and x' (formula XIV) are at least 7. Minimum COV emulsions can be prepared with category S-II surfactants chosen so that the lipophilic block (e.g., LAO2) accounts for 40 to 96 (optimally 60 to 90) percent of the total surfactant molecular weight. The minimum molecular weight of the surfactant continues to be determined by the minimum value of x (formula XI) of 13. The same molecular weight ranges for both category S-I and S-II surfactants are applicable as in using regular gelatino-peptizer as described above.

The polyalkylene oxide block copolymer surfactant can, if desired, be removed from the emulsion after it has been fully prepared. Any convenient conventional washing procedure, such as those illustrated by *Research Disclosure*, Vol. 389, September 1996, Item 38957, Section III, can be employed. The polyalkylene oxide block copolymer surfactant constitutes a detectable component of the final emulsion when present in concentrations greater than 0.02 percent, based on the total weight of silver.

The photographic emulsions, once formed by the process of this invention, can be sensitized, combined with other photographic addenda, and incorporated into photographic elements in any convenient conventional manner, as illustrated by *Research Disclosure*, Item 38957, cited above, noting particularly the following sections:

IV. Chemical sensitization;

V. Spectral sensitization a. Sensitizing dyes;

VII. Antifoggants and stabilizers;

VIII. Absorbing and scattering materials;

IX. Coating and physical property modifying addenda;

X. Dye image formers and modifiers;

XI. Layers and layer arrangements;

XII. Features applicable only to color negative

XIII. Features applicable only to color positive

B. Color reversal

C. Color positives derived from color negatives; and

XIV. Scan facilitating features.

EXAMPLES

The invention can be further appreciated by reference to the following specific embodiments. All of the emulsions were prepared in the presence of a polyalkylene oxide block copolymer surfactant and exhibited COV's of less than 25%.

The suffixes x and c are used to distinguish emulsion preparations that satisfy the invention from those that are included for purposes of comparison.

Emulsions Ac+ and Ac−

These emulsions demonstrate the differences in mean grain ECD's and thicknesses (t) that result, in the absence of a partially dissociated acid (PDA), from overshooting (+) or undershooting (−) aim (optimum) nitric acid addition by 20 percent.

Emulsion Ac+

An 18 liter reaction vessel was charged with an aqueous solution consisting of 4,456.3 g of water, 2.52 g (0.56 g/L) of alkali-processed oxidized gelatin, 5.56 g (1.235 g/L) of sodium bromide, 1.56 g of a 70.8 wt. % methanolic solution of Pluronic 31R$^{1}$™ surfactant (x=x'=25, y=7 in formula IX, 61.9 wt. % based on total silver used in nucleation), 10.11 g of ammonium sulfate and 18.5 g of 4.0M nitric acid. At 45° C. and with vigorous stirring, 30.0 mL of a 0.35M silver nitrate solution (1.78 g of silver nitrate) were added over 1 minute followed by a 1 minute hold. After the hold, 26.7 mL of 2.5M sodium bromide (6.87 g of sodium bromide) were added over 1 minute followed again by a 1 minute hold. The temperature was then raised to 60° C. over a period of 9 minutes. At the completion of the temperature ramp, 93.5 g of 2.5M sodium hydroxide were added and the solution was held for 9 minutes. Following the hold, a 1.5 liter solution containing 150 g of alkali processed low methionine gelatin and 0.26 g of the 70.8% methanolic solution of Pluronic 31R1 were added. One minute after the gel solution addition, 42.0 g of 4.0M nitric acid were added and the solution was held for 2 minutes. After the hold, 81.2 ml of 2.5 M NaBr were added over 4 min followed by a 1 minute hold. Afterward, a 0.35M silver nitrate solution was added using a linearly increasing flowrates from 14.5 to 60.0 mL/min over 10.4 minutes. This was followed by a 1 minute hold. The linearly increasing flow of 0.35M silver nitrate was then continued from 60 mL/min to 85 mL/min over 15.8 min with the 2.5M sodium bromide solution added at approximately 9.3 to 13.1 ml/min to maintain a constant excess halide level. Then a 2.4M silver nitrate solution was added with linearly increasing flowrates from 12.4 to 67.5 mL/min over 71.24 min simultaneously with a 2.5M sodium bromide solution ramped from approximately 12.6 mL/min to 67.5 mL/min to maintain a constant excess halide level.

The resulting emulsion had a mean grain ECD of 4.68 μm and a mean grain thickness was 0.100 μm.

Emulsion Ac−

This emulsion was prepared identically to Emulsion Ac+, except the amount of 4.0M nitric acid added after the gel solution addition was reduced to 28.0 g.

The resulting emulsion had a mean grain ECD of 3.98 μm and a mean grain thickness of 0.138 μm.

Emulsions Bx+ and Bx−

These emulsions demonstrate the reduced differences in mean grain ECD's and thicknesses (t) that result, in the presence of the partially dissociated acid (PDA) succinic acid, from undershooting (+) or overshooting (−) an aim sodium hydroxide addition level by 20 percent.

Emulsion Bx+

This emulsion was prepared identically to Emulsion Ac+, except 18.60 g of succinic acid and 53.37 g of 2.5M sodium hydroxide were added to the 1.5 liter gel solution.

The resulting emulsion had a mean grain ECD of 4.05 μm and a mean grain thickness of 0.099 μm.

Emulsion Bx−

This emulsion was prepared identically to Emulsion Bx+, except the level of 2.5M sodium hydroxide solution added with the 1.5 liter gel solution was increased to 75.15 g. The resulting emulsion had a mean grain ECD of 3.85 μm and a mean grain thickness of 0.102 μm.

Emulsions Cx+ and Cx−

These emulsions demonstrate the reduced differences in mean grain ECD's and thicknesses (t) that result, in the presence of the partially dissociated acid (PDA) o-phthalic acid, from overshooting (+) or undershooting (−) aim nitric acid addition by 20 percent.

Emulsion Cx+

This emulsion was prepared identically to Emulsion Ac+, except 32.17 g of monopotassium phthalate and 45.56 g of 2.5M sodium hydroxide were added to the 1.5 liter gel solution. Added simultaneously were 35 g of 4.0M nitric acid.

The resulting emulsion had a mean grain ECD of 3.76 μm and a mean thickness of 0.098 μm.

Emulsion Cx−

This emulsion was prepared identically to Emulsion Cx+, except the level of 4.0M nitric acid was reduced to 21 g.

The resulting emulsion had a mean grain ECD of 3.46 μm and a mean grain thickness of 0.117 μm.

Emulsions Dx+ and Dx−

These emulsions demonstrate the differences in mean grain ECD's and thicknesses (t) that result, in the presence of the PDA citric acid, from undershooting (+) or overshooting (−) aim sodium hydroxide addition by 20 percent.

Emulsion Dx+

This emulsion was prepared identically to Emulsion Ac+, except 30.26 g of citric acid and 106.05 g of 2.5M sodium hydroxide were added along with the 1.5 liter gel solution.

The resulting emulsion had a mean grain ECD of 4.56 μm and a mean grain thickness of 0.103 μm.

Emulsion Dx−

This emulsion was prepared identically to Emulsion DX+, except 127.84 g of sodium hydroxide were added along with the 1.5 liter gel solution.

The resulting emulsion had a mean grain ECD of 4.2 μm and a mean grain thickness of 0.109 μm.

Emulsions Ex+ and Ex−

These emulsions demonstrate the reduced differences in mean grain ECD's and thicknesses (t) that result, in the presence of the PDA acetic acid, from overshooting (+) or undershooting (−) aim nitric acid addition by 20 percent.

Emulsion Ex+

This emulsion was prepared identically to Emulsion Ac+, except that 214.3 g of sodium acetate and 72.0 g of 4.0M nitric acid were added with the 1.5 L gel solution.

The resulting emulsion had a mean grain ECD of 3.74 μm and a mean grain thickness of 0.096 μm.

Emulsion Ex−

This emulsion was prepared identically to Emulsion Ex+, except that the nitric acid addition was reduced to 58.0 g.

The resulting emulsion had a mean grain ECD of 4.04 μm and a mean grain thickness of 0.096 μm.

Emulsions Fx+ and Fx−

These emulsions demonstrate the reduced differences in mean grain ECD's and thicknesses (t) that result, in the presence of the PDA phosphoric acid, from overshooting (+) or undershooting (−) aim nitric acid addition by 20 percent.

Emulsion Fx+

This emulsion was prepared identically to Emulsion Ac+, except that 21.43 g of monopotassium phosphate and 37.0 g of 4.0M nitric acid were added with the 1.5 L gel solution.

The resulting emulsion had a mean grain ECD of 4.57 μm and a mean grain thickness of 0.099 μm.

Emulsion Fx−

This emulsion was prepared identically to Emulsion Fx+, except that the nitric acid addition was reduced to 23.0 g.

The resulting emulsion had a mean grain ECD of 4.02 μm and a mean grain thickness of 0.115 μm.

Emulsions Gc+ and Gc−

These emulsions demonstrate the high differences in mean grain ECD's and thicknesses (t) that result when the partially dissociated acid (PDA) lactic acid has a pKa that differs excessively from the aim pH. Nitric acid (+) and sodium hydroxide (−) additions are used to create the 20 percent variances from aim hydrogen ion additions.

Emulsion Gc+

This emulsion was prepared identically to Emulsion Ac+, except 16.69 g of an 85% aqueous lactic acid solution and 7.0 g of 4.0M nitric acid were added to the 1.5 liter gel solution.

The resulting emulsion had a mean grain ECD of 4.39 μm and a mean grain thickness of 0.101 μm.

Emulsion Gc−

This emulsion was prepared identically to Emulsion Ac+, except 16.69 g of an 85% aqueous lactic acid solution and 9.04 g of 2.5M sodium hydroxide solution were added with the 1.5 liter gel solution.

The resulting emulsion had a mean grain ECD of 4.085 μm and a mean grain thickness of 0.134 μm.

Emulsions Hc+ and Hc−

These emulsions demonstrate the high differences in mean grain ECD's and thicknesses (t) that result when the partially dissociated acid (PDA) L-tyrosine has a pKa that differs excessively from the aim pH. The emulsion preparations differ by overshooting (+) or undershooting (−) aim nitric acid addition by 20 percent.

Emulsion Hc+

This emulsion was prepared identically to Emulsion Ac+, except that 28.5 g of L-tyrosine were added with the 1.5 L gel solution along with 42.0 g of 4.0M nitric acid.

The resulting emulsion had a mean grain ECD of 4.53 μm and a mean grain thickness of 0.099 μm.

Emulsion Hc−

This emulsion was prepared identically to Emulsion Hc+, except that the nitric acid addition was reduced to 28.0 g.

The resulting emulsion had a mean grain ECD of 3.90 μm and a mean grain thickness of 0.135 μm.

A summary of emulsion observations is provided in Table XXIII. The symbol pH* designates the aim pH. The symbol A represents the difference between corresponding parameters in + and − emulsions of each pair. ECD and t differences are in percent.

TABLE XXIII

| Emul. | PDA | | | Δ | Δ |
|---|---|---|---|---|---|
| Pair | M/L | pKa | pKa-pH* | ECD | t |
| Ac | none | — | — | 16.2 | 31.9 |
| Bx | 0.025 | 5.61 | −0.09 | 5.1 | 3.0 |
| Cx | 0.025 | 5.51 | −0.19 | 8.8 | 17.7 |
| Dx | 0.025 | 5.51 | +0.7 | 6.6 | 5.7 |
| Ex | 0.25 | 4.75 | −0.95 | 7.7 | 0.0 |
| Fx | 0.025 | 7.2 | +1.5 | 12.8 | 15.0 |
| Gc | 0.025 | 3.1 | −2.6 | 7.1 | 28.1 |
| Hc | 0.025 | 8.4 | +2.7 | 14.9 | 30.8 |

All of the Example emulsion pairs demonstrated lower variances in average aspect ratio than the comparative emulsion pairs.

All of the emulsions were monodisperse, and the presence or absence of the partially dissociated acid appeared to have little influence on absolute levels of dispersity. However, all of the Example emulsion pairs exhibited less variances in grain size dispersity than the comparative emulsion pairs.

Although the emulsions prepared using the partially dissociated acids lactic acid and L-tyrosine are labeled as comparative emulsions, it is appreciated that they offered some improvement over the complete absence of a partially dissociated acid. Nevertheless, the reduction in grain ECD and thickness variances was significantly lower than that realized when the requirements of the invention were satisfied. It is recognized that lactic acid and L-tyrosine would be useful partially dissociated acids for use in the practice of the invention in emulsion preparations in which aim pH is chosen to lie nearer to the pKa of these partially dissociated acids.

Emulsion Ic

This emulsion was precipitated identically to Emulsion Ac+, except that 23.8 g of 2-mercaptobenzoxazole and 11 g of a 2.5M sodium hydroxide solution were added to the 1.5 L gel solution addition, and 24 g of 4.0M nitric acid solution (equivalent to the optimum or aim level) was added following the gel solution addition.

The resulting emulsion showed no grains with tabular morphology and appeared to be composed of small polymorphic crystals.

This failure to achieve a tabular grain emulsion is attributable to the low solubility of silver salts of 2-mercaptobenzoxazole. James *The Theory of the Photographic Process*, 4th Ed., Macmillan, New York, 1977, p. 8, Table 1.4 reports the pKsp (−log Ksp) of 2-mercaptobenzoxazole to be 18.0 at 25° C. and 15.6 at 18° C., which is higher than the pKsp of all silver halides.

Analysis by ion chromatography of emulsions prepared by the processes of the invention using citric acid as the partially dissociated acid revealed that small concentrations (a few micrograms per gram of emulsion) of citrate anion could sometimes be observed in the emulsions. This indicates that small inclusions of the silver salt of the partially dissociated acid in the grain structure are compatible with the practice of the invention.

The invention has been described in detail with particular reference to preferred embodiments thereof, but it will be understood that variations and modifications can be effected within the spirit and scope of the invention.

What is claimed is:

1. A process of preparing a photographic emulsion having silver halide grains including tabular grains containing greater than 50 mole percent bromide, based on silver, and accounting for greater than 90 percent of total grain projected area, the coefficient of variation of grain equivalent circular diameter, based on total grains, being less than 25 percent, said process being comprised of the steps of forming in the presence of a dispersing medium containing a polyalkylene oxide block copolymer surfactant a population of silver halide grain nuclei containing twin planes, the halide content of the grain nuclei consisting essentially of silver bromide, and growing the silver halide grain nuclei containing twin planes to form tabular silver halide grains,

WHEREIN the silver halide grain nuclei are grown at a pH in the range of from 3.0 to 8.0 and in the presence of at least a 0.01M concentration of a partially dissociated acid having a pKa that is within 2.5 units of the pH and that forms a silver salt more soluble than the silver halide incorporated in the grains.

2. A process according to claim 1 wherein the pH at which the grain nuclei are grown to form tabular grains is chosen to render the dispersing medium acidic.

3. A process according to claim 2 wherein the pH at which the grain nuclei are grown to form tabular grains is in the range of from 5.0 to 7.0.

4. A process according to claim 1 wherein the pKa of the partially dissociated acid is within 1.5 units of the pH of the dispersing medium in which the grain nuclei are grown to form tabular grains.

5. A process according to claim 1 wherein the tabular grains are grown in the presence of bromide and iodide ions.

6. A process according to claim 1 wherein the partially dissociated acid is acetic acid.

7. A process according to claim 1 wherein the partially dissociated acid is succinic acid.

8. A process according to claim 1 wherein the partially dissociated acid is citric acid.

9. A process according to claim 1 wherein the partially dissociated acid is phosphoric acid.

10. A process according to claim 1 wherein a fully dissociated acid is employed in combination with the partially dissociated acid to maintain the pH during growth of the grain nuclei to form tabular grains.

11. A process according to claim 10 wherein the fully dissociated acid is nitric, sulfuric or hydrochloric acid.

* * * * *